US006997320B1

(12) United States Patent
Kancsar et al.

(10) Patent No.: US 6,997,320 B1
(45) Date of Patent: Feb. 14, 2006

(54) CHILD-RESISTANT PACKAGING FOR TABLETS

(75) Inventors: Peter Kancsar, Zurich (CH); Laurenz Zellweger, Zurich (CH); Michael Krohn, Zurich (CH); Claudia Schmauder, Zurich (CH); Susanne Marti, Zurich (CH)

(73) Assignee: Alcan Technology & Management, Neuhausen am Rheinfall (CH)

( * ) Notice: Subject to any disclaimer, the term of this patent is extended or adjusted under 35 U.S.C. 154(b) by 0 days.

(21) Appl. No.: 09/926,580

(22) PCT Filed: May 13, 2000

(86) PCT No.: PCT/EP00/04330

§ 371 (c)(1),
(2), (4) Date: Jun. 3, 2002

(87) PCT Pub. No.: WO00/75044

PCT Pub. Date: Dec. 14, 2000

(30) Foreign Application Priority Data

Jun. 2, 1999 (EP) ..... 99810480

(51) Int. Cl.
*B65D 83/04* (2006.01)

(52) U.S. Cl. ..... 206/532; 206/538

(58) Field of Classification Search ..... 206/530–536, 206/828, 538, 539, 461–469, 528; 221/25
See application file for complete search history.

(56) References Cited

U.S. PATENT DOCUMENTS

| | | | | |
|---|---|---|---|---|
| 3,203,541 A | * | 8/1965 | Rein | 206/539 |
| 3,429,426 A | * | 2/1969 | Weller et al. | 206/531 |
| 5,150,793 A | | 9/1992 | Tannenbaum | |
| 5,244,091 A | | 9/1993 | Tannenbaum | |
| 5,339,960 A | | 8/1994 | Price | |
| 5,377,839 A | * | 1/1995 | Relyea et al. | 206/531 |
| 5,379,899 A | * | 1/1995 | Thurell | 206/538 |
| 5,613,609 A | | 3/1997 | Hamilton et al. | |
| 5,727,687 A | * | 3/1998 | Renner | 206/532 |
| 5,758,774 A | * | 6/1998 | Leblong | 206/531 |
| 6,138,830 A | * | 10/2000 | Muggli | 206/532 |

FOREIGN PATENT DOCUMENTS

| | | |
|---|---|---|
| WO | WO 94-27555 | 12/1994 |
| WO | WO 98-00353 | 1/1998 |

* cited by examiner

*Primary Examiner*—Luan K. Bui

(74) *Attorney, Agent, or Firm*—Fisher Christen & Sabol

(57) ABSTRACT

A child-resistant yet senior-friendly packaging for tablets, capsules or similar pharmaceutical products. The packaging is a blister pack (12) with at least one cup (22) that receives tablets (18) in an external package, arranged between a base part (14) and a cover part (16), and that is closed by a cover film (24) that can be pressed through. The cover film (24) of the blister pack (12) is directed towards the base part (14) and the base part (14) comprises an opening (38) through which the product can be withdrawn. The cup (22) of the blister pack (12) is displaceably guided in a slot (30) in the cover part (16) and can be brought in alignment with the opening (38) in the base part (14) so that the cover film (24) can be pressed through and the tablet (18) can be withdrawn. A tear tab (32) is detachably linked with the cover part (16) via a perforated line (36) and covers the slot (30) at least partially.

32 Claims, 2 Drawing Sheets

Figure 5:
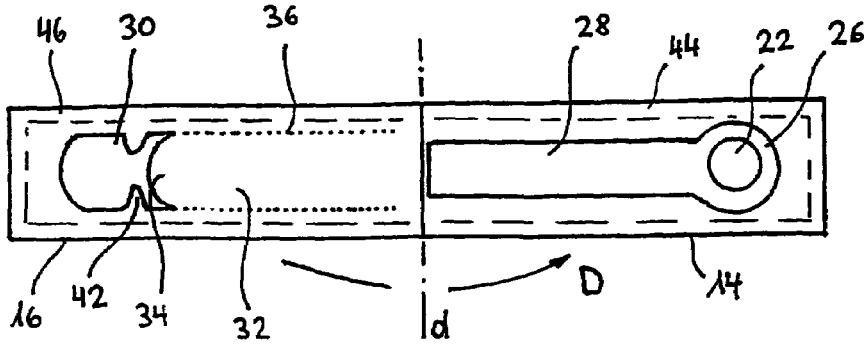

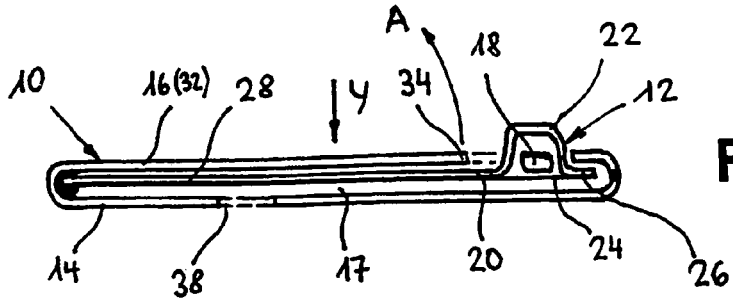
Fig.1
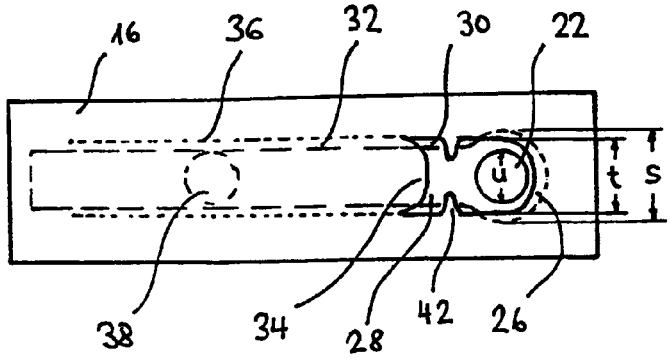
Fig.2
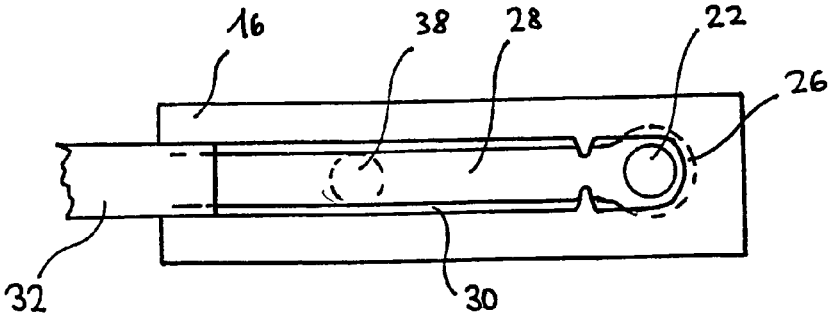
Fig.3
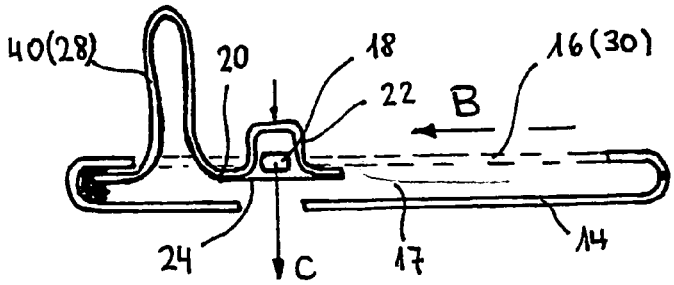
Fig.4
Fig.6
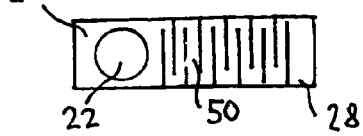
Fig.7
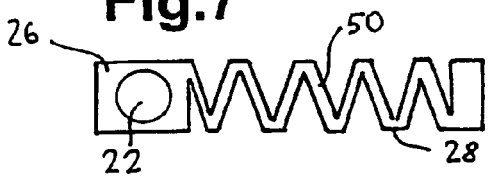

CHILD-RESISTANT PACKAGING FOR TABLETS

This is a 371 of International Application No. PCT/EP00/04330, filed on May 13, 2000, that has benefit of European Patent Application No. 99810480.6, filed on Jun. 2, 1999.

The invention concerns a child-safe packing for tablets, capsules and similar pharmaceutical products with a blister pack with at least one cup to hold the tablets or capsules sealed by means of a push-through cover film, in which packing the blister pack is arranged between a base part and a cover part of an outer pack, the cover film of the blister pack facing towards the base part, the base part having a removal opening and the cup of the blister pack is movable and guided in an opening slot in the cover part and can be brought over the removal opening in the base part to push through the cover film and remove the tablets.

The danger of unsupervised consumption of drugs is undisputed, where in particular small children are greatly exposed to this potential risk especially when drugs are left lying around.

Blister packs have become the predominant form of packaging for tablets and capsules. Push-through packs, in which the tablets are pushed through a cover film from a cup in the base of the packing, have become very common. In other known blister packs a cover film is removed by peeling. Other blister packs have a notch as a tear aid.

The possibilities exploited today for increasing the child-safety of the said blister packs for tablets and capsules consist of rendering opening more difficult by measures which require increased force, e.g. thicker push-through films, stronger adhesion of peel films or high tear resistance at tear notches.

Packs which can only be opened with increased use of force are indeed child-safe but can constitute a problem for the elderly.

U.S. Pat. No. 5,150,793 discloses child-safe packing for tablets, capsules and similar pharmaceutical products with a blister pack with at least one cup to hold the tablets sealed by means of a push-through cover film, in which packing the blister pack is arranged between a base part and a cover part of an outer pack, the cover film of the blister pack facing towards the base part, the base part having a removal opening and the cup of the blister pack is movable and guided in an opening slot in the cover part and can be brought over the removal opening in the base part to push through the cover film and remove the tablets.

The invention is based on the task of creating a child-safe packing of the type described initially which can easily be opened by the elderly. Essentially, the packing is structured such that its opening requires a combination skill, or simultaneous or complex movements must be performed.

The task according to the invention is solved by child-safe packing for tablets, capsules and similar pharmaceutical products with a blister pack with at least one cup to hold the tablets sealed by means of a push-through cover film, in which packing the blister pack is arranged between a base part and a cover part of an outer pack, the cover film of the blister pack facing towards the base part, the base part having a removal opening and the cup of the blister pack is movable and guided in an opening slot in the cover part and can be brought over the removal opening in the base part to push through the cover film and remove the tablets, the opening slot has a width (t) which is less than the diameter (s) of a shoulder of the cup but greater than the diameter (u) of the cup, and in that a tear-off strip which at least partly covers the opening slot and is separable by way of a weakening line is connected to the cover part.

Opening the packing according to the invention requires a combination ability in the sense that it must be perceived that to press the tablets through, the cup must be brought over the removal opening.

Preferably the tear-off strip at least partly covering the opening slot is connected with the cover part by way of a perforation line.

In a suitable design of the packing according to the invention, projections protrude inwards from the edge of the opening slot inhibiting the free movement of the cup.

Advantageously, the blister pack is connected with a spring element countering the sliding movement. Preferably, this spring element is part of the blister pack.

In a particularly low cost production variant the outer pack consists of a single cut-out.

A double pack can be produced in a simple manner from two symmetrically arranged mirror part packings.

At least two packings can be combined into multi-portion packs, where the individual packings are arranged next to each other in a strip pack and preferably can be separated from the strip pack along a weakening line, preferably a perforation line.

For production of the packing according to the invention, rigid, semi-rigid and flexible materials known today for the production of packing, in the form of sheets, films, laminates or other layer materials in a thickness from a few mm to a few mm, preferably 8 mm to 3 mm, can be used. Examples of film-like materials are metal foils such as aluminum foil. Other examples of film-like materials are paper, semi-cardboard and cardboard. Particularly important are plastic-containing films, e.g., those based on polyolefins such as polyethylenes or polypropylenes, polyamides, polyvinyl chloride, polyesters such as polyalkylene terephthalates and, in particular, polyethylene terephthalate. The plastic-containing films can be monofilms of plastics, laminates of two or more plastic films, laminates of metal and plastic films, laminates of paper and plastic films or laminates of paper and metal and plastic films. The individual layers of the film-like materials can be attached to each other by means of adhesives, pastes, adhesive promotion agents and/or by extrusion coating, coextrusion or laminating, etc. Suitable plastic films are, for example, non-oriented or axially or biaxially oriented monofilms or laminates of two or more non-oriented or axially or biaxially oriented films of plastics based on polyolefins such as polyethylenes or polypropylenes, polyamides, polyvinyl chloride, polyesters such as polyalkylene terephthalates and, in particular, polyethylene terephthalate, cyclo-olefin-copolymers (CO) and polychloro-trifluoroethylene (PCTFE, trademark ACLAR).

Particularly suitable for the base parts of blister packs are transparent plastics with good molding properties such as polyethylene, polypropylene, cyclo-olefin-copolymers (COC), polyvinyl chloride, polyethylene terephthalate, polyamide and laminates made from the same materials, e.g., PVC and polychloro-trifluoroethylene (PCTFE) or PVC and PVDC (polyvinyldichloride). For non-transparent blister packs, for example, laminates are used of an aluminum film coated on both sides with a plastic film with, for example, the structure polyamide/aluminum/PVC or pigmented plastic films. The cover film is usually an aluminum film of, for example, a thickness of 20 mm that can be painted and/or coated with a hot seat lacquer.

All of the above film-like materials such as paper, semi-cardboard, cardboard and plastic films in the form of monofilms, laminates, etc., can have at least one further continuous layer of ceramic materials sputtered or deposited from a vacuum in a thickness of approximately 5 to 500 nm (nanometers) for example $Al_2O_3$ or $SiO_x$, where x is a number between 1.5 and 2. These layers of ceramic materials have barrier properties and prevent the diffusion of gases and water vapors through the packing.

Figure 8:
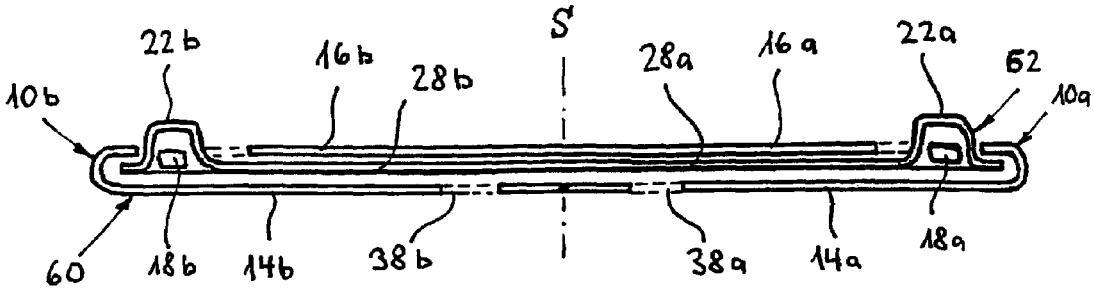
Figure 9:
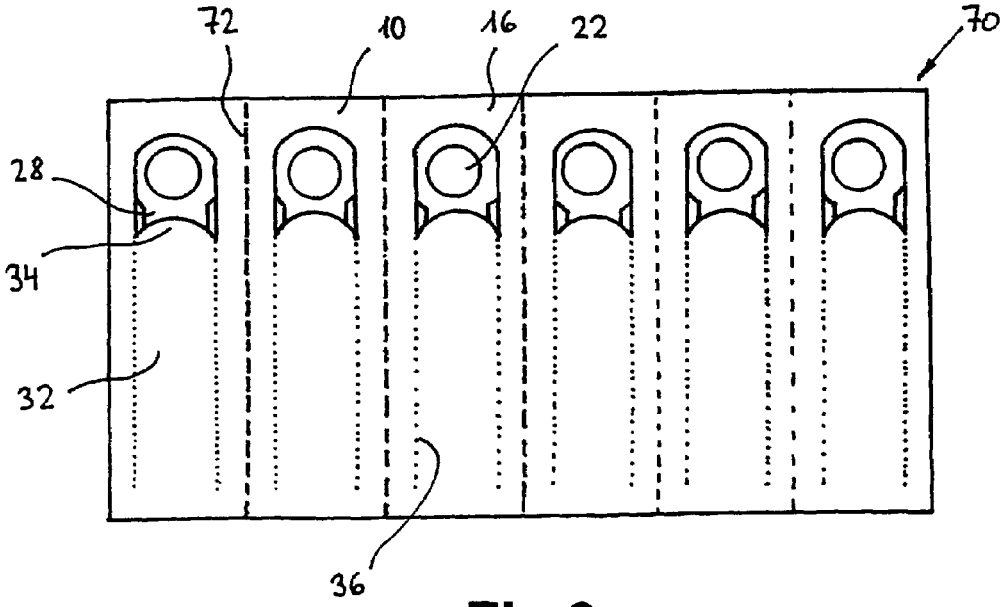

Further advantages, features and details of the invention arise from the description of preferred embodiments below and the drawings; these show diagrammatically FIG. 1 a longitudinal section through a blister pack with outer pack;

FIG. 2 a top view onto the outer pack of FIG. 1 in direction y;

FIG. 3 a top view onto the opened outer pack of FIG. 1 in direction y;

FIG. 4 a longitudinal section through the blister pack with opened outer pack of FIG. 3 in the removal position;

FIG. 5 a top view onto a cut-out for production of the outer pack in FIG. 1;

FIG. 6 a top view onto a blister pack with integral spring element;

FIG. 7 a top view onto the blister pack of FIG. 6 with spring elements under tension;

FIG. 8 a longitudinal section through a blister pack structured according to FIG. 1 with outer pack as a double packing;

FIG. 9 a top view onto a blister pack with outer pack in FIG. 1 structured as a multi-portion pack.

An outer pack 10 shown in FIGS. 1 to 4, for example, has cardboard for a blister pack 12 of essentially strip-like structure, and has a base part 14 and a cover part 16. The blister pack 12—in the example shown as a single portion pack for a tablet 18—has a base part 20 of, for example, polyvinyl chloride (PVC) with a cup 22 molded from this to hold the tablet 18, and a cover film 24 of, for example, aluminum sealed or glued to a base part 20. The base part 20 of the blister pack 12 in the area of the cup 22 forms a peripheral shoulder 26 with a diameter s and is connected as one piece with a spring strip 28.

The cover part 16 of the outer pack 10 is formed as one piece with the base part 14 and with this forms a loop where the cover part 16 and base part 14 lie opposite each other, approximately parallel, forming an intermediate space 17. The cover part 16 has an opening slot 30, the width t of which is less than the diameter s of the shoulder 26 of the cup 22 but greater than the diameter u of the cup 22 in the area of the base part 20. When the outer pack 10 is closed, the opening slot 20 up to the area of the cup 22 is connected with a tear-off strip 32 arranged integrally in the cover part 16 with the tear tab 34 and releasable from the cover part 16 by way of a weakening line or linear perforations 36.

The blister pack 12 is arranged in the outer pack 10 so that the shoulder 26 of the base part 20 protrudes sideways in the edge area of the opening slot 30 into the intermediate space 17 between the base part 14 and cover part 16, where the cup 22 protrudes outward from the plane of the cover part 16. In the base part 14 of the outer pack 10 is provided a removal opening 38, when viewed from above lying within the opening slot 30 and covered by the tear-off strip 32.

To remove the tablet 18 the tear-off strip 32 is held at the tear tab 34 and separated from the cover part 16 by an opening movement in arrow direction A, creating the opening slot 30. The tear tab 34 arranged in the area of the cup 22 in the example shown can evidently also be provided on the side of the tear-off strip further away from the cup 22, where in this case the opening movement takes place towards the cup 22. The cup 22 protruding from the cover part 16 can now—for example by a movement with the thumbs—be pushed along the opening slot in arrow direction B until the cup 22 is above the removal opening 38 in the base part 14 of the outer pack 10. In this position, the removal opening 38—separated only by the cover film 22—lies free opposite the tablet 18 in the cup 22. In this open position the tablet 18 can be pushed by finger pressure on the cup 22 in arrow direction C through the cover film 24 and ejected through the removal opening 38. The removal opening 38 can also be covered by a push-through opening seal. This additional seal is for example bordered by a weakening line e.g. a perforation line, and is separated at the same time as the cover film 24 is pushed through.

The movement described above of the cup 22 within the opening slot 30 takes place against the return force of a spring strip 28 which deforms into a resiliently tensioned loop 40 according to FIG. 4 so that the cup 22 after release returns automatically to the starting position. In the area of the cup 22 on both sides of the opening slot 30, open even when the outer pack 10 is closed, projections 42 protrude inwards from the cover part 16. These projections 42 inhibit the free movement of the cup 22 in the direction of removal opening 38 after the tear-off strip 32 has been pulled away, i.e. movement of the cup 22 into the removal position requires first a certain force to displace the projections 42 protruding into the opening slot 32.

The essentially strip-like cut out for the outer pack 10 shown in FIG. 5 shows the weakened and therefore easily separable connection between the tear-off strip 32 with tear tab 34 as a perforation line 36 in the cover part 16. The blister pack 12 with spring strips 28 already lies on the base part. The outer pack is closed by folding the cover part 16 in arrow direction D about a fault line d until the cover part 16 lies on the base part 14 or blister pack 12. With this step there is at least partial adhesion of the edge part 42 of the cover part 16 with the edge parts 46 of the base part 14 to form the intermediate space 17 serving as a guide for the shoulder 26 of the cover 22.

FIGS. 6 and 7 show another possibility for generating a return force for the cover 22 in the opening slot 30. The spring strip 28 is here fitted with notches 48 arranged alternately on both sides so that the spring strip 28 can be extended in the strip direction forming a spring tape 50 generating a return force. In this variant the spring strip 28 is attached to the end of the outer pack 10 lying closest to the head 31 of the opening slot 30. The spring strips 28 with notches 48 can be made directly from the material of the base part 20 and/or the cover film 24 of the blister pack 12. It is however also possible to produce the spring strips 28 separately and connect these to the blister pack 12. Instead of a spring strip 28 evidently another spring material for example a rubber band can also be provided.

An outer pack 60 shown in FIG. 8 for blister pack 52—in the example a two portion pack for two tablets 18*a, b*—is essentially made from outer packs 10 according to FIG. 1 arranged mirror symmetrically to each other. The same parts therefore have the same reference numbers, where the double structure is indicated by the suffix a or b. The base parts 14*a, b* are connected together as one piece and with the cover parts 16*a, b* in each case form a loop. In the closed position the two outer packs 1O*a, b* lie either side of a mirror symmetry plane S. The two part outer packs 1O*a, b* can be opened in the same way and the tablets 18*a, b* removed in the same way as in the outer pack 10 shown in FIGS. 1 to 5.

FIG. 9 shows a strip-like packing 70 with six individual packs according to FIG. 1 arranged next to each other. These can be separated from each other by linear perforations 72. The individual outer packs 10 can however also be opened without needing to be separated from the packing strip 70. Such a strip arrangement is also suitable for the outer pack 60 with a two-portion blister pack 62 according to FIG. 8.

A further advantage of the packing according to the invention is that the printable surfaces for the application of consumer information can be enlarged considerably.

What is claimed is:

1. A child-safe packing for tablets, capsules and similar pharmaceutical products with a blister pack (12) with at least one cup (22) to hold the tablets (18) sealed by means of a push-through cover film (24), in which packing the blister pack (12) is arranged between a base part (14) and a cover part (16) of an outer pack (10), the cover film (24) of the blister pack (12) faces towards the base part (14), the base part (14) has a removal opening (38), the cup (22) of the blister pack (12) is movable and guided in an opening slot (30) in the cover part (16) and can be brought over the removal opening (38) in the base part (14) to push through the cover film (24) and remove the tablets (18), the dimension of a shoulder (26) of the cup (22) transverse to the opening slot (30) is greater than the width of the opening slot (30) and the dimension of cup (22) transverse to opening slot (30) is less than the width of the opening slot (30), tear-off strip (32) which at least partly covers the opening slot (30) and is separable by way of a weakening line (36) that is connected to the cover part (16), and the cup (22) has a bottom portion and a side wall portion, and the side wall portion of cup (22) extends out of the opening slot (30) so that the bottom portion of cup (22) is located beyond the plane of outer surface of cover part (16).

2. The packing according to claim 1, wherein the weakening line (36) is a perforation line.

3. The packing according to claim, wherein the removal opening (38) is covered by a push-through opening seal.

4. The packing according to claim 2, wherein the removal opening (38) is covered by a push-through opening seal.

5. The packing according to claim 1, wherein the blister pack (12) is connected to a spring element (28), thereby counteracting the sliding movement.

6. The packing according to claim 5, wherein the spring element (28) is part of the blister pack (12).

7. The packing according to claim 2, wherein the blister pack (12) is connected to a spring element (28), thereby counteracting the sliding movement.

8. The packing according to claim 7, wherein the spring element (28) is part of the blister pack (12).

9. The packing according to claim 3, wherein the blister pack (12) is connected to a spring element (28), thereby counteracting the sliding movement.

10. The packing according to claim 9, wherein the spring element (28) is part of the blister pack (12).

11. The packing according to claim 1, wherein the outer pack (10) has a single cut.

12. The packing according to claim 2, wherein the outer pack (10) has a single cut.

13. The packing according to claim 3, wherein the outer pack (10) has a single cut.

14. The packing according to claim 5, wherein the outer pack (10) has a single cut.

15. A double packing that comprises two part packings according to claim 1 arranged mirror symmetrically to each other.

16. A double packing that comprises two part packings according to claim 2 arranged mirror symmetrically to each other.

17. A double packing that comprises two part packings according to claim 14 arranged mirror symmetrically to each other.

18. A multi-portion pack of at least two packings according to claim 1, wherein the individual packings are arranged next to each other into a strip pack (70).

19. A multi-portion pack of at least two packings according to claim 1, wherein the individual packings are arranged next to each other into a strip pack (70) and are separable from the strip pack (70) along a weakening line.

20. A multi-portion pack of at least two packings according to claim 17, wherein the individual packings are arranged next to each other into a strip pack (70) and are separable from the strip pack (70) along a perforation line (72).

21. A child-safe packing for tablets, capsules and similar pharmaceutical products with a blister pack (12) with at least one cup (22) to hold the tablets (18) sealed by means of a push-through cover film (24) in which packing the blister pack (12) is arranged between a base part (14) and a cover part (16) of an outer pack (10), the cover film (24) of the blister pack (12) faces towards the base part (14), the base part (14) has a removal opening (38), the cup (22) of the blister pack (12) is movable and guided in an opening slot (30) in the cover part (16) and can be brought over the removal opening (38) in the base part (14) to push through the cover film (24) and remove the tablets (18), the dimension of shoulder (26) of the cup (22) transverse to the opening slot (30) is greater than the width of the opening slot (30) and the dimension of cup (22) transverse to the opening slot (30) is less than the width of the opening slot (30), projections (42) protrude inward from the edge of the opening slot (30), thereby inhibiting the free movement of the cup (22), a tear-off strip (32) which at least partly covers the opening slot (30) and is separable by way of a weakening line (36) that is connected to the cover part (16), and the cup (22) has a bottom portion and a side wall portion, and the side wall portion of cup (22) extends out of the opening slot (30) so that the bottom portion of cup (22) is located beyond the plane of outer surface of cover part (16).

22. The packing according to claim 21, wherein the blister pack (12) is connected to a spring element (28), thereby counteracting the sliding movement.

23. The packing according to claim 22, wherein the spring element (28) is part of the blister pack (12).

24. The packing according to claim 21, wherein the outer pack (10) has a single cut.

25. A multi-portion pack of at least two packings according to claim 21 wherein the individual packings are arranged next to each other into a strip pack (70) and are separable from the strip pack (70) along a perforation line (72).

26. A double packing that comprises two part packings according to claim 21 arranged mirror symmetrically to each other.

27. A child-safe packing for tablets, capsules and similar pharmaceutical products with a blister pack (12) with at least one cup (22) to hold the tablets (18) sealed by means of a push-through cover film (24), in which packing the blister pack (12) is arranged between a base part (14) and a cover part (16) of an outer pack (10), the cover film (24) of the blister pack (12) faces towards the base part (14), the base part (14) has a removal opening (38), the cup (22) of the blister pack (12) is movable and guided in an opening slot (30) in the cover part (16) and can be brought over the removal opening (38) in the base part (14) to push through the cover film (24) and remove the tablets (18), the dimension of shoulder (26) of the cup (22) transverse to the opening slot (30) is greater than the width of the opening slot (30) and the dimension of cup (22) transverse to opening slot (30) is less than the width of the opening slot (30), projections (42) protrude inward from the edge of the opening slot (30), thereby inhibiting the free movement of the cup (22), and a tear-off strip (32) which at least partly covers the opening slot (30) and is separable by way of a weakening line (36) that is connected to the cover part (16), the weakening line (36) is a perforation line, and the cup (22) has a bottom portion and a side wall portion, and the side wall portion of cup (22) extends out of the opening slot (30) so that the bottom portion of cup (22) is located beyond the plane of outer surface of cover part (16).

28. A double packing that comprises two part packings according to claim 27 arranged mirror symmetrically to each other.

29. A multi-portion pack of at least two packings according to claim 27, wherein the individual packings are arranged next to each other into a strip pack (70) and are separable from the strip pack (70) along a weakening line.

30. A child-safe packing for tablets, capsules and similar pharmaceutical products with a blister pack (12) with at least one cup (22) to hold the tablets (18) sealed by means of a push-through cover film (24), in which packing the blister pack (12) is arranged between a base part (14) and a cover part (16) of an outer pack (10), the cover film (24) of the blister pack (12) faces towards the base part (14), the base part (14) has a removal opening (38), the cup (22) of the blister pack (12) is movable and guided in an opening slot (30) in the cover part (16) and can be brought over the removal opening (38) in the base part (14) to push through the cover film (24) and remove the tablets (18), the removal opening (38) is covered by a push-through opening seal, the dimension of shoulder (26) of the cup (22) transverse to the opening slot (30) is greater than the width of the opening slot (30) and the dimension of cup (22) transverse to opening slot (30) is less than the width of the opening slot (30), projections (42) protrude inward from the edge of the opening slot (30), thereby inhibiting the free movement of the cup (22), and a tear-off strip (32) which at least partly covers the opening slot (30) and is separable by way of a weakening line (36) that is connected to the cover part (16), and the cup (22) has a bottom portion and a side wall portion, and the side wall portion of cup (22) extends out of the opening slot (30) so that the bottom portion of cup (22) is located beyond the plane of outer surface of cover part (16).

31. A double packing that comprises two part packings according to claim 30 arranged mirror symmetrically to each other.

32. A multi-portion pack of at least two packings according to claim 30, wherein the individual packings are arranged next to each other into a strip pack (70) and are separable from the strip pack (70) along a perforation line (72).

* * * * *